United States Patent [19]

Keiser

[11] 4,257,593

[45] Mar. 24, 1981

[54] PNEUMATIC EXERCISING DEVICE

[75] Inventor: Dennis L. Keiser, Sanger, Calif.

[73] Assignee: Keiser Corporation, Fresno, Calif.

[21] Appl. No.: 862,545

[22] Filed: Dec. 20, 1977

[51] Int. Cl.[1] ..... A63B 21/00

[52] U.S. Cl. ..... 272/130; 272/DIG. 1; 272/DIG. 4; 272/DIG. 5; 272/143; 272/144

[58] Field of Search ..... 272/130, 144, DIG. 4, 272/116, 143, DIG. 1, DIG. 6; 267/65 R, 124, 118; 60/418, 416, 413

[56] References Cited

U.S. PATENT DOCUMENTS

| | | | |
|---|---|---|---|
| 1,015,071 | 1/1912 | Reach | 272/72 |
| 3,387,843 | 6/1968 | Chandler | 272/130 |
| 3,451,271 | 6/1969 | Knoblauch | 272/130 X |
| 3,692,296 | 9/1972 | Higginbotham | 267/65 R |
| 3,784,194 | 1/1974 | Perrine | 272/130 X |
| 3,822,599 | 7/1974 | Brentham | 272/130 X |
| 4,050,310 | 9/1977 | Keiser | 272/130 X |

*Primary Examiner*—William R. Browne
*Attorney, Agent, or Firm*—Huebner & Worrel

[57] ABSTRACT

An exercising device having a frame, a member borne by the frame for movement relative to the frame, a source of compressed gas, a reservoir having an internal chamber of adjustable capacity connecting in receiving relation to gas from the source, and an assembly interconnecting the member and the frame and connected to the reservoir for compression of a selected volume of gas in the internal chamber upon movement of the member relative to the frame.

14 Claims, 5 Drawing Figures

FIG. 3.
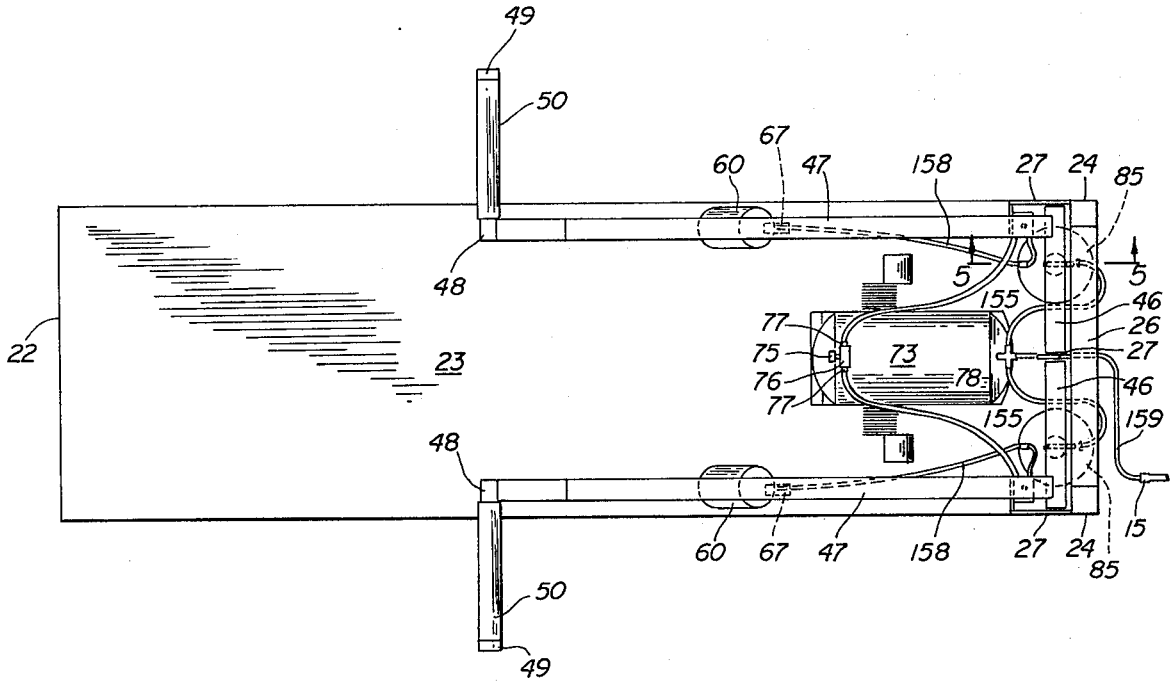
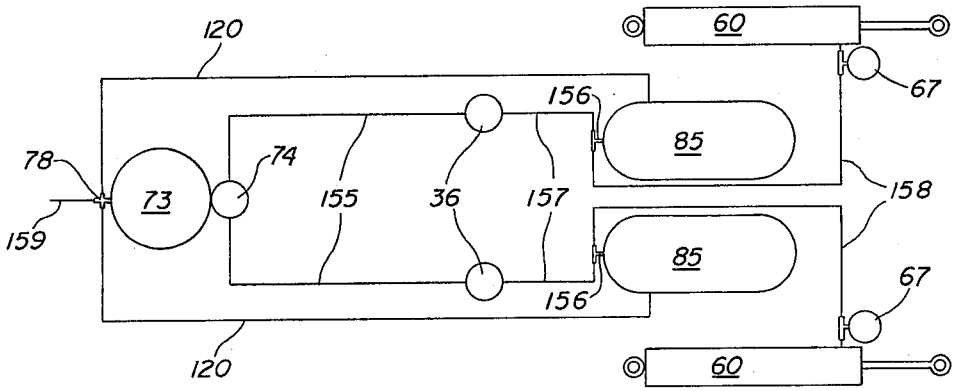
FIG. 4.

PNEUMATIC EXERCISING DEVICE

BACKGROUND OF THE INVENTION

1. Field of the Invention

The present invention relates to a pneumatic exercising device and more particularly to such a device which is operable to duplicate the superior operative characteristics of "weight type" exercising machines while avoiding the undesirable characteristics of these and other exercising machines in a device which is compact, dependable and readily adjustable for selection of both the desired extent and character of the resistance force.

2. Description of the Prior Art

The art in the area of exercising equipment is extensive. Many devices have been developed of the "weight type" wherein weights are employed in the resistance to the exertion of muscular force. Perhaps the simplest of these are barbells, but a host of machines of this type have been developed which employ weight stacks of a variety of types against which muscular force is exerted in exercising to achieve or maintain muscular development. Machines of the "weight type" suffer from several common deficiencies which detract from their desirability. Such machines are normally rather cumbersome and expensive. They do not possess the infinite degree of adjustability which would be desired. Perhaps more importantly for certain exercising operations, these machines, by their use of weight stacks, create an inertia of movement once the lifting operation has begun which does not require optimum use of the muscles throughout the exercising stroke.

A variety of types of hydraulic machines, such as that of the applicant's U.S. Pat. No. 4,050,310, have been developed. In many instances they have been developed in an effort to overcome some of the deficiencies experienced with the "weight type" variety of exercising machine. Hydraulic machines overcome many of these disadvantages, but possess certain disadvantages of their own. Hydraulic machines do not retain some of the advantages in the "weight type" exercising machines. For example, in a "weight type" machine, if the selected total weight is beyond the capability of the person who is to exercise, he cannot operate the machine. The greatest weight lifted using the machine thus becomes an index of the capability of the operator. Accordingly, such machines are quite useful, for example, in training for weight lifting competition in which barbells are used. However, in a hydraulic machine virtually any hydraulic resistance force can be overcome by the steady application of muscular force. Additionally, and perhaps more importantly, hydraulic machines do not permit the development of the speed with which exercising is performed nor do they simulate the necessity in "weight type" machines of working against the resistance force on the return stroke to the rest position. Furthermore, hydraulic machines, as in "weight type" machines, create an inertia of motion which does not demand the maximum effort throughout the exercising stroke.

Therefore, it has long been known that it would be desirable to have an exercising device which simulates the desired characteristics of a "weight type" exercising machine permitting the operator to increase both the magnitude of weight effectively lifted and the speed with which such weight can be lifted; which does not create an inertia of motion demanding less of the operator after movement has begun thereby insuring full muscular effort throught the stroke; and which is compact, dependable and permits a virtually infinite range of ajustment of the extent and character of the resistance force.

SUMMARY OF THE INVENTION

Therefore, it is an object of the instant invention to provide an improved exercising device.

Another object is to provide such an exercising device which employs pneumatics in creating resistance to the muscular force exerted during the exercising operation.

Another object is to provide such an exercising device which simulates the superior operative characteristics of "weight type" exercising devices in that the operator can only overcome, or in effect lift, a resistance force within his range of capability, but if the resistance force is within his range he is able to increase the speed with which such can be lifted during the exercising stroke.

Another object is to provide such an exercising device which exerts a force during the return stroke against which the operator must work much in the manner of a "weight type" exercising device.

Another object is to provide such an exercising device which, unlike "weight type" and hydraulic exercising machines, does not permit the operator to employ inertia of motion to his advantage once movement is initiated and which actually requires the operator to exert the same or greater muscular force at the upper reaches of the exercising stroke than is applied initially in the exercising stroke.

Another object is to provide such an exercising device which possesses a simplicity of structure and operation insuring a long operational life and permitting the device to be sold at a modest price.

Another object is to provide such an exercising device which permits either unilateral or bilateral operation solely at the will of the operator and without any prior adjustment of the device.

Another object is to provide such a device which permits the operator to select both the magnitude of the pneumatic pressure against which muscular force is to be applied during the exercising operation as well as the volume of gas to be compressed.

Another object is to provide such a device which readily lends itself to the use of a multiple station compressed gas system requiring only one source of compressed gas for the operation of a plurality of the exercising devices.

Another object is to provide such a device which possesses safety features to minimize the risk of injury to an operator including an automatic mechanism to prevent the increase of resistance force during any given exercising stroke.

A further object is to provide such an exercising device which is adaptable to a wide variety of structures and modes of operation without significant modification of the device.

Further objects and advantages are to provide improved elements and arrangements thereof in an apparatus for the purposes described which is dependable, economical, durable and fully effective in accomplishing its intended purposes.

BRIEF DESCRIPTION OF THE DRAWINGS

FIG. 3 is a top plan view of the exercising device.

FIG. 4 is a schemmatic diagram of the pneumatic circuit of the exercising device.

DESCRIPTION OF THE PREFERRED EMBODIMENT

Figure 1:
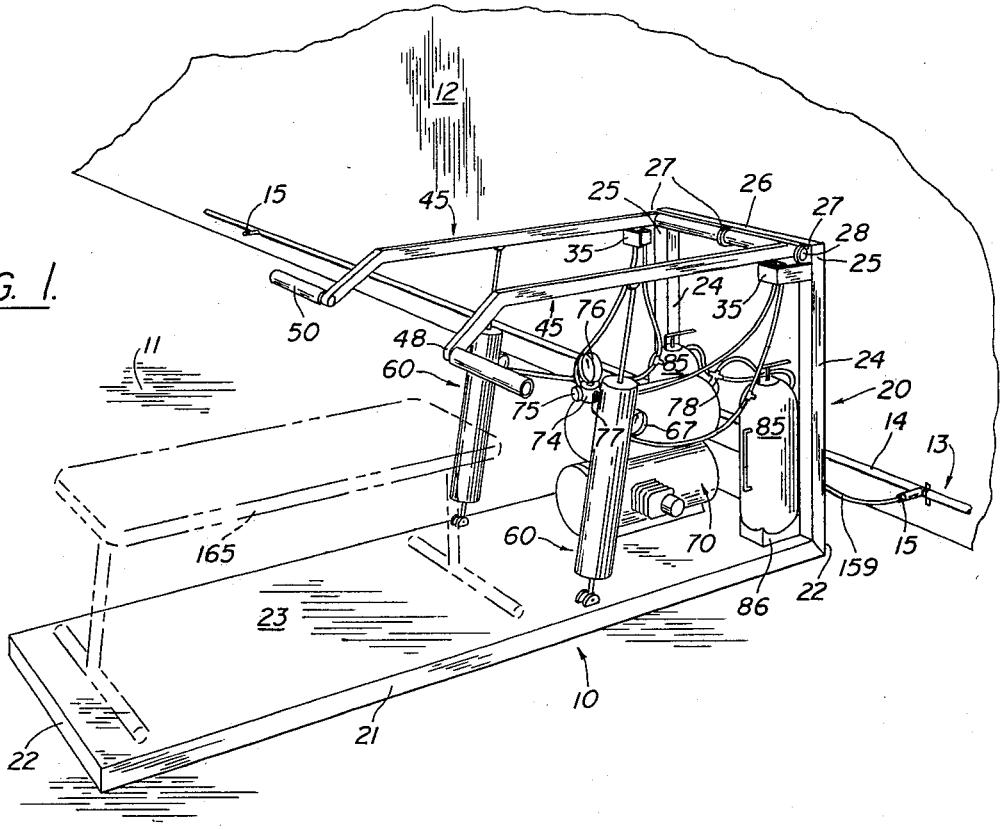
FIG. 1 is a fragmentary perspective view of the exercising device of the present invention shown in a typical operative environment.

Referring more particularly to the drawings, the pneumatic exercising device of the present invention is generally indicated by the numeral 10 in FIG. 1. The device is shown in a typical operative environment in FIG. 1 in a room such as a gymnasium or the like. The device 10 is positioned in rested relation on a floor 11 immediately adjacent to a wall 12. It will become apparent that the device 10 can be operated in numerous ways from a source of a suitable compressed gas such as compressed air. For illustrative convenience, the device is shown and described herein to afford its own source of compressed air which is set up to supply other such devices 10 through a pneumatic system 13. The pneumatic system has a conduit 14 mounted in and extending longitudinally of the wall horizontally adjacent to the floor. A plurality of outlets 15 are mounted on the conduit and individually extend outwardly through the wall substantially normal to the conduit for use as will hereinafter be described. It will be understood that the pneumatic system is a sealed system to which access can be gained only through the outlets 15.

The pneumatic exercising device 10 has a frame 20. The frame has a rectangular base or platform 21 having a substantially flat configuration and is received in rested relation on the floor 11. The platform has opposite ends 22 and an upper surface 23. A pair of vertical supports 24 are secured in upstanding relation on the upper surface 23 of the platform immediately adjacent to one of the opposite ends of the platform. The supports are disposed in predetermined spaced, substantially parallel relation. The vertical supports have upper ends 25 which are interconnected by a cross bar 26 secured on the ends and extending therebetween substantially parallel to the platform. Three flanges 27 are affixed, as by welding, on the upper ends 25 of the supports 24 and the cross bar 26 in spaced, substantially parallel relation extending to the left as viewed in FIG. 2. An elongated cylindrical shaft 28 is mounted on the flanges 27 so as to interconnect the flanges and to extend in spaced, parallel relation to the cross bar 26.

Figure 2:
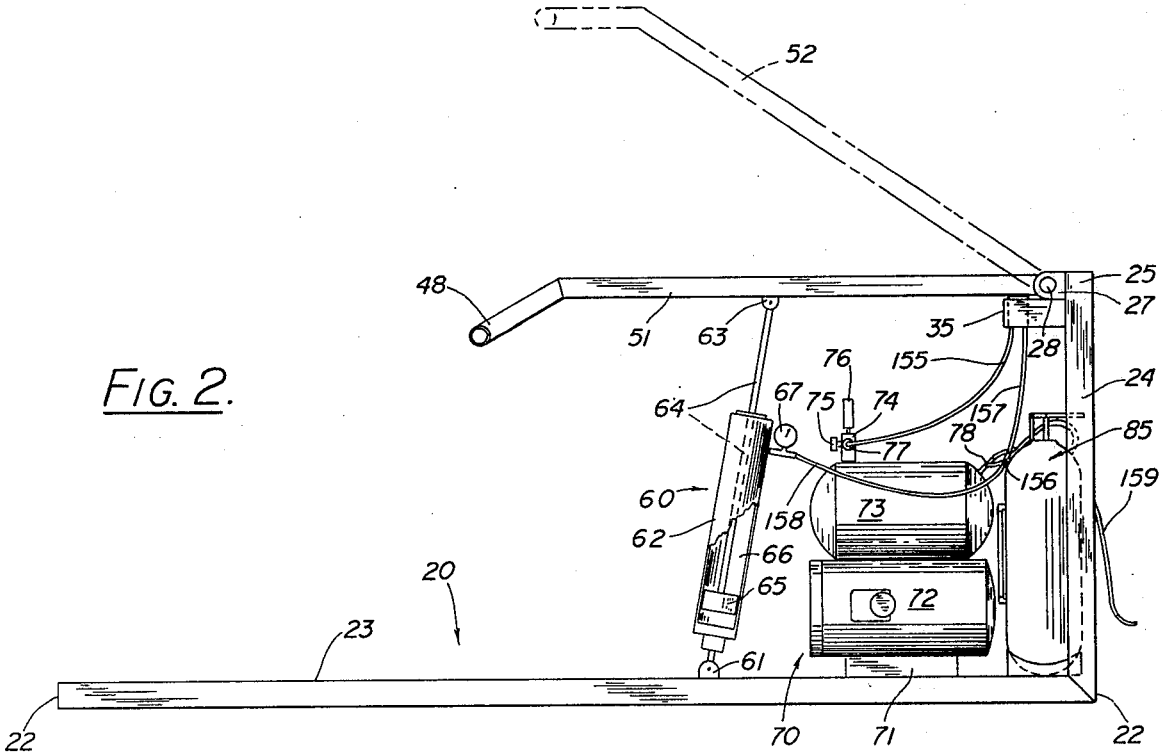
FIG. 2 is a somewhat enlarged fragmentary side elevation of the exercising device showing the exercising member thereof in full lines in a retracted position and in phantom lines in an extended position.
Figure 5:
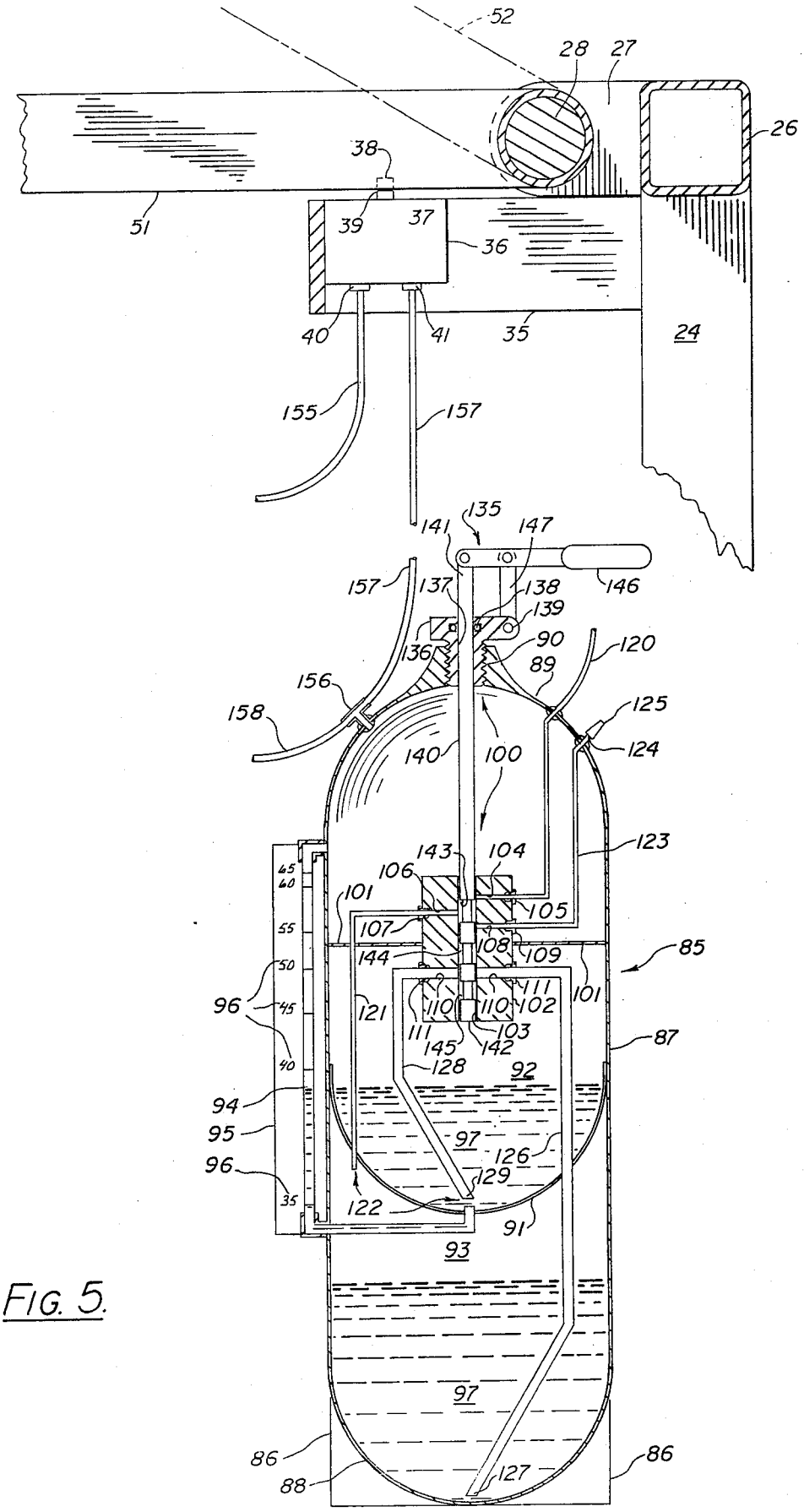
FIG. 5 is a somewhat enlarged fragmentary vertical section taken on line 5—5 in FIG. 3.

A pair of return bent brackets 35 are individually secured on the supports 24 adjacent to their upper ends 25 and extending toward the left as viewed in FIG. 2. A normally closed pneumatic valve 36 is individually fastened on each bracket in predetermined spaced relation to the upper end of its respective vertical support, as best shown in FIG. 5. Each valve 36 has a spring loaded plunger 37 extending upwardly therefrom above the bracket. The plunger of each valve is normally resiliently retained in an extended position 38 indicated by dashed lines in FIG. 5. However, the plunger can be depressed against spring pressure to a retracted position 39 as shown in full lines in FIG. 5. Each valve has an input coupling 40 through which compressed air is admitted to the valve and an output coupling 41 through which compressed air is discharged from the valve. It will be understood that the valve 36 is normally closed, preventing the passage of air therethrough, when the plunger is in the extended position 38. By depression of the plunger to the retracted position 39, passage of air through the valve is permitted.

A pair of exercising members 45 are individually mounted for pivotal movement on the shaft 28 of the frame 20. Each member has a sleeve 46 which is rotationally received on the shaft 28 between adjacent flanges 27, as best shown in FIG. 1. An arm 47 is borne by each sleeve extending therefrom to the left as viewed in FIG. 2 and aligned with one of the valves 36 for rested engagement with the plunger 37 thereof. Each arm has a remote end 48 mounting a shaft or handle 49 extending laterally of the apparatus substantially normal to the arm, as best shown in FIG. 3. Each handle preferably mounts a suitable grasping sleeve 50 for rotational movement thereabout As can best be seen in FIGS. 2 and 5, each arm is retained in a retracted position generally indicated at 51 in which the arm is disposed in rested relation on the plunger of its respective valve to retain the plunger in its retracted position 39. Each arm is pivotal, as will hereinafter be described, along a fixed path of travel to an extended position indicated in phantom lines at 52 in FIGS. 2 and 5. When an arm is moved from the retracted position, the plunger 37 of its respective valve is thereby released and forced under spring pressure to its extended position 38 thereby to prevent the passage of air through the valve 36.

A pair of pneumatic cylinders 60, constituting pneumatic resisting mechanisms, individually interconnect the platform 21 and the exercising members 45 as shown best in FIGS. 1 and 2. Each of the pneumatic cylinders has a lower mounting assembly 61 affixed on the upper surface 23 of the platform in vertical alignment with the arm 47 of its respective exercising member 45. Each lower mounting assembly permits pivotal movement about an axis extending transversely of the platform. A cylindrical housing 62 is mounted on each mounting assembly 61. A mount 63 is secured on each arm 47 in the position shown in FIG. 2. A connecting rod 64 is borne for pivotal movement on each mount 63. In the conventional fashion, each connecting rod extends axially inwardly of its respective cylindrical housing 62. A piston 65 is fastened on the remote downwardly extending end of the connecting rod for reciprocal movement within the cylinder. It will be seen that the piston and the cylindrical housing above the piston define a chamber 66 which diminishes in volume as the exercising member of that pneumatic cylinder is moved from the retracted position 51 to the extended position 52 thus moving the piston on an energy storing compression stroke. Conversely, the chamber 66 increases in volume as the exercising member is moved from the extended position to the retracted position thus moving the piston on an energy releasing stroke. A pressure gauge 67 is mounted on each pneumatic cylinder in communication with the upper end of the chamber 66. The pressure gauge has a needle or hand which is adapted to register the pressure developed within the cylinder during each exercising stroke as will hereinafter be described. Preferably the gauge has a second needle or hand which registers the maximum pressure created within the chamber during exercising.

A source of compressed gas, in this case an air compressing assembly 70, is mounted on the upper surface 23 of the platform 21 between the pneumatic cylinders 60 and the vertical supports 24. The assembly has a mount 71 affixed on the upper surface of the platform. As previously noted, the pneumatic exercising device 10 can employ any suitable type of gas. However, in the preferred embodiment the device utilizes compressed air. Accordingly, the assembly 70 has an air compressor 72 which is secured on the mount 71. The air compressor can be of any suitable type such as the two stage 175 PSIG Golden Head pump manufactured by Bell & Gossett. This specific air compressor is capable of producing 175 pounds per square inch continuous operating pressure. A storage reservoir 73 is mounted on the air compressor 72 in receiving relation to the compressed air produced by the air compressor. It will be understood that, in the conventional manner, the air compressor operates automatically to maintain air pressure within the storage reservoir within a given range such as from one hundred to one hundred and ten pounds per square inch.

An air pressure regulator 74 is mounted on the reservoir in receiving relation to the compressed air contained in the reservoir. The pressure regulator mounts a dial 75 which can manually be adjusted to select a given air pressure, equal to or less than that maintained in the storage reservoir, to be released from the reservoir through the pressure regulator. A gauge 76 is borne by the regulator and is operable to indicate the air pressure released through the regulator from the reservoir. The regulator has a pair of output couplings 77 through which compressed air is discharged from the reservoir at the selected pressure. A three port coupling 78 is fastened on the reservoir at the end thereof opposite to the regulator and communicates with the interior of the reservoir for the discharge of compressed air therethrough. The pressure of the air released through the coupling 78 is, of course, equal to that maintained within the reservoir since the coupling is an open connection not connected to a regulator.

The device 10 mounts a pair of compression reservoir assemblies 85 positioned individually adjacent to the vertical supports 24 on the platform 21. Each assembly 85 has mounts 86 which are fastened on the upper surface 23 of the platform. A pressure housing, reservoir or tank 87 is secured on the mounts of each reservoir assembly in upstanding relation. As best shown in FIG. 5, each pressure tank has a lower end 88 which is directly engaged in the mounts and an opposite upper end 89 disposed vertically thereabove. A screwthreaded opening 90 is provided in the upper end 89 of each pressure tank. A wall 91 is mounted in sealed relation, as by welding, within each pressure tank in a predetermined position as best shown in FIG. 5. The wall separates the interior of the pressure tank into a first chamber 92 disposed between the wall and the upper end of the pressure tank and a second chamber 93 disposed between the wall and the lower end of the pressure tank. The wall is airtight for purposes subsequently to be described.

A sight gauge or tube 94 is fastened on the tank preferably on the side thereof on the left as viewed in FIG. 2 and communicates at its opposite ends with the first chamber in vertically spaced relation. The tube mounts a plate 95 bearing suitable indicia 96. The chambers contain a given volume of fluid 97, such as hydraulic fluid. The fluid level of the first chamber is indicated by the sight gauge 94 by means of the fluid flowing upwardly in the gauge to seek a level corresponding to that of the fluid level within the first chamber in the well recognized manner. The indicia 96 preferably indicate the percentage increase in the resistance force from the start to the completion of an exercising stroke for a given level of the fluid within the first chamber.

A control valve assembly 100 is mounted within each compression reservoir assembly 85. Each control valve assembly has a spider mount 101 secured on its respective tank within the first chamber 92 and substantially centrally thereof. A valve body 102 is affixed in the spider mount aligned axially of the pressure tank. The valve body has an axial passage 103 extending therethrough. A first radial passage 104 is extended from communication with the axial passage to the exterior of the valve body to the right as viewed in FIG. 5. A coupling 105 is fastened on the valve body in communication with the first radial passage. A second radial passage 106 is extended from communication with the axial passage to the left as viewed in FIG. 5 and communicates at its outward end with the exterior of the valve body through a coupling 107. A third radial passage 108 is extended from communication with the axial passage to the right as viewed in FIG. 5 and communicates with the exterior of the valve body through a coupling 109. A transverse passage 110 extends through the valve body communicating with the axial passage internally of the valve body in communicating with the exterior of the valve body through a pair of couplings 111 at the opposite ends thereof. The passages 104, 106, 108 and 110 communicate with the axial passage in predetermined vertically spaced relation, as best shown in FIG. 5.

A first valve conduit 120 extends from one of the ports of the three port coupling 78 of the air compressing assembly 70 through the pressure tank 87 into the first chamber 92 thereof and is secured on the coupling 105 of the first radial passage 104. A second valve conduit 121 is fastened on the coupling 107 of the second radial passage 106 and extends to a remote end 122 communicating with the second chamber 93 of the pressure tank 87. A third valve conduit 123 is affixed on the coupling 109 of the third radial passage 108 and extends outwardly through the pressure tank to a remote end 124 externally of the tank. An air filter 125 is borne by the remote end of the conduit 123. A fourth valve conduit 126 extends from a remote end 127 in the second chamber 93 immediately adjacent to the lower end 88 of the pressure tank through the wall 91 of the pressure tank and is secured on one of the couplings 111 of the transverse passage 110. A fifth valve conduit 128 is affixed on the other of the couplings 111 of the transverse passage 110 and extends to a remote end 129 within the first chamber 92 immediately adjacent to the wall 91, as best shown in FIG. 5. It will be understood that all of the conduits herein described and the connections thereof are airtight and of sufficient strength to withstand the internal pressures involved in transferring compressed air therealong without being ruptured or otherwise leaking.

The control valve assembly 100 has a lever mechanism 135. The lever mechanism includes an externally screwthreaded mount 136 which is screwthreadably secured in the screwthreaded opening 90 of the pressure tank 87. The mount has a passage 137 extending axially therethrough. Seals such as at 138 circumscribe the passage. The mount has a pivotal connection 139 extending to the right as viewed in FIG. 5. A valve plunger 140 has an upper end portion 141 slidably received in the axial passage 137 of the mount 136 and an opposite lower end portion 142 slidably received in the axial passage 103 of the valve body 102. The plunger 140 has a first passage 143 extending concentrically thereabout in a predetermined position, as best shown in FIG. 5. A second passage 144 extends concentrically about the plunger in predetermined spaced relation below the first passage 143. A third passage 145 extends about the plunger concentric thereto in a predetermined position below the second passage 144.

A lever arm 146 is pivotally mounted on the upper end portion 141 of the plunger extending to the right as viewed in FIG. 5. A linkage 147 pivotally interconnects the connection 139 of the mount 136 and the lever arm 146. Thus, it will be seen that movement of the lever arm 146 either upwardly or downwardly causes the passages 143, 144 and 145 to be positioned relative to the radial passages 104, 106 and 108 and the transverse passage 110 so as to operate the valve. The control valve assembly 100 is shown in its "normal" position in FIG. 5 wherein all of the radial passages 104, 106 and 108 and the transverse passage 110 are sealed to prevent air and fluid transfer through the valve. If the lever arm is moved downwardly, the plunger 140 is thus elevated to a "first" attitude in which conduit 120 communicates with radial passage 106 and the second valve conduit 121. In this first attitude the second radial passage 108 is sealed and the transverse passage 110 is open through the third passage 145 of the plunger. If the lever arm is raised from the normal position shown in FIG. 5, the plunger 140 is accordingly lowered in the valve body 102 to a "second" attitude. In the second attitude the first radial passage 104 is sealed and the radial passages 106 and 108 are interconnected through the first passage 143. In this attitude the second passage 144 is positioned in communication with the transverse passage 110.

As can perhaps best be seen in FIG. 3 and as shown diagrammatically in FIG. 4, a pair of first supply conduits 155 individually interconnect the output couplings of the pressure regulator 74 and the input couplings of the normally closed valves 36. It will be understood that the setting of the dial 75 of the regulator 74 controls the air pressure within the storage reservoir 73 and thus the air pressure available to the valves 36 through the conduits 155. A T-coupling 156 is individually mounted on each of the pressure tanks 87 in communication with the first chamber 92 thereof, as best shown in FIG. 5. A second supply conduit 157 individually interconnects each of the output couplings 41 of the valves 36 and their respective T-couplings 156. Third supply conduits 158 individually interconnect the T-couplings 156 and the pressure gauges 67 of the respective pneumatic cylinders 60 in air supplying relation to the chambers 66 of the pneumatic cylinders. A fourth supply conduit 159 is connected to one of the ports of the coupling 78 of the storage reservoir 73 and extends into engagement with one of the outlets 15 of a pneumatic system 13 in air supplying relation. It will be understood that the conduits 155, 157, 158 and 159 and the couplings 156 are mounted as described so as to transfer compressed air therethrough without rupturing or otherwise leaking.

Although a variety of types of equipment can be used in combination with the exercising device 10, a bench 165 is shown for illustrative convenience in FIG. 1 disposed on the platform 21 in position for an operator to use the exercising members 45 in what is referred to as a "bench press" exercise.

OPERATION

Operation of the described embodiment of the subject invention is believed to be clearly apparent and is briefly summarized at this point. Prior to actual operation of the exercising apparatus 10, the apparatus is adjusted for the selection of the desired resistance force against which the operator will exercise. The device can be adjusted in two different respects which individually affect the resistance force.

First, the dial 75 of the pressure regulator 74 is adjusted to the appropriate setting for the air pressure desired. Adjustment of the dial sets the pressure of air released from the storage reservoir through the output couplings 77 of the regulator. The gauge 76 registers the actual pressure of the air released from the couplings. The conduits 155 connected to the output couplings are open thus supplying air of the selected pressurization to the normally closed valves 36. Since the conduits 120 and 159 are open from the storage reservoir 73 through the coupling 78, compressed air is supplied to the control valve assemblies 100 through the lines 120, and to the pneumatic system 13 through the conduit 159. Compressed air at the pressure maintained in the storage reservoir is thus made available to the outlets 15 of the pneumatic system through the conduit 14 for operation of other exercising devices 10.

Second, the control vlave assemblies 100 of the compression reservoir assemblies 85 are adjusted using the lever mechanisms 135 thereof. The compression reservoir assemblies 85 can be individually adjusted for different settings thus permitting the operator to have different resistance forces operating on the exercising members. However, the compression reservoir assemblies 85 are normally adjusted to the same settings. Adjustment is accomplished by using the sight gauge 94 of each pressure tank 87. As indicated by the sight gauge, the operator determines what volume of air space is available in the first chamber 92 of each tank for the receipt of compressed air to be further compressed during the exercising operation. Of course, if the desired volume of space is already existent in each pressure tank, no further adjustment is necessary. In fact, by adjusting the pressure regulator 74 as previously described, the resistance force at the start of an exercising stroke can be precisely controlled without need of adjusting the control valve assemblies 100.

However, there are numerous situations which make it highly desirable to select the precise volume within which air of the selected pressure is to be compressed. In any situation in which the operator wishes to increase the resistance force exerted on the exercising members in the upper reaches of the stroke beyond that achieved in the existent setting, the air space within the first chambers 92 of the pressure tanks should be decreased. In any situation in which the operator wishes to decrease the resistance force exerted on the exercising members in the upper reaches of the stroke below that achieved in the existent setting, the air space within the first chambers of the pressure tanks should be increased. Thus, for a given air pressure, a reduction in the volume of space within which air of the pressure is placed achieves a greater increase of the pressure for a given stroke of the exercising member than where the volume of space is increased. Such adjustment may be desirable in numerous situations. If an operator is setting up the device for his own use and is following an operator who has a longer reach than he and thus, as a result, he has a shorter stroke, he will want to increase the pressure in the upper reaches of the stroke if he is to work against a resistance force throughout the stroke which is precisely the same as that of the prior user. Similarly, for purposes of specific muscular development or speed development it may be desirable either to increase or decrease the percentage gain in the resistance force in the upper reaches of the stroke. Accordingly, it has been found to be highly beneficial for the indicia 96 on the plates 95 of the sight gauges 94 to indicate the percentage increase in the resistance force at the upper end of the stroke over that at the beginning of the stroke for a given fluid level rather than simply to indicate the volume of available air space within the first chamber. It has been found that for most usages a percentage increase of fifty to sixty percent in the pressure of the air from the beginning to the end of the stroke is optimum.

The following table lists illustrative examples of the percentage increase in the resistance force at the end of a stroke over the resistance force at the beginning of the stroke for the listed available reservoir volume. The table assumes that the hydraulic cylinder is 2.5 inches in diameter and accommodates a 12 inch stroke, but the increase indicated is at the completion of a 10 inch stroke.

TABLE NO. 1

| Available Reservoir, Cylinder And Conduit Volume In Cubic Inches | Percentage Increase In The Resistance Force At End Of 10 Inch Stroke |
|---|---|
| 481.06 | 10% |
| 130.43 | 35 |
| 112.90 | 40 |
| 88.36 | 50 |
| 79.43 | 55 |
| 71.99 | 60 |
| 65.70 | 65 |
| 39.27 | 100 |

Turning then to the procedure by which such adjustment is accomplished if the operator desires to reduce the usable volume of space within the first chamber 92 of either pressure tank 87, he presses downwardly on the lever arm 146 of the lever mechanism 135 to raise the valve plunger 140 within the valve body 102 thus positioning the plunger in the raised or first attitude. This operation positions the first passage 143 of the plunger in communication with the first radial passage 104 and second radial passage 106 of the valve body. Since the first valve conduit 120 is in open communication with the interior of the storage reservoir 73 of the air compressor assembly 70 by way of the discharge coupling 77, the positioning of the valve plunger in the first attitude causes compressed air to travel along the first valve conduit 120 through the second valve conduit 121 and into the second chamber 93 of that pressure tank. This operation creates a pressure imbalance between the first and second chambers of the pressure tank. Since pressure is greater within the second chamber, the fluid 97 is forced upwardly along the fourth valve conduit 126, through the third passage 145 of the valve plunger 140 and into the first chamber of the pressure tank through the fifth valve conduit 128. Thus, the operator, using the sight gauge 94 can reduce the usable volume in the first chamber to the desired amount. The precise desired volume is reached by using the lever arm 146 to place the valve plunger in the normal or closed attitude when the sight gauge indicates that this volume has been achieved.

Conversely, when it is desired to increase the volume of space available within the first chamber 92 of a pressure tank 87, the lever arm 146 is raised to position the valve plunger 140 in the lower or second attitude. This positions the first passage 143 of the plunger in communication with the second radial passage 106 and third radial passage 108 of the valve body 102. Such communication permits the pressurized air within the second chamber 93, which is of course at greater than atmospheric pressure, to travel upwardly through the second valve conduit 121, through the first passage 143, through the third valve conduit 123, and out of the compression reservoir assembly 85 through the air filter 125. Thus, again a pressure imbalance is created between the second chamber 93 and first chamber 92. The pressure imbalance causes the fluid 97 within the first chamber 92 to be forced upwardly through the fifth valve conduit 128, the second passage 144 of the plunger and downwardly into the second chamber through the fourth valve conduit 126. Thus, the usable volume within the first chamber is increased to the desired amount as controlled by the lever arm 146 and as indicated by the sight gauge 94.

Thereafter, the operator simply uses the exercising members 45 either individually or together; that is, either unilaterally or bilaterally. For example, if the operator is performing a bench press, he lays on his back on the bench 165, grasps the sleeves 50 of the handles 49 and forces the exercising members from his chest from the retracted position 51 to the extended position 52. Once movement of an arm 47 is initiated, the plunger 37 of its normally closed valve 36 is released to move to its extended position 38, thus shutting off the flow of compressed air through the valve. This safety feature insures that the operator is not forced to work against even greater pressure than he has set up the device for by inadvertent resetting of the dial 75 of the pressure regulator 74.

Thus, a given volume and pressure of compressed air is entrapped in the chambers 66 of the pneumatic cylinders 60, the third supply conduits 158, the first chambers 92 of the pressure tanks 87 and the second supply conduits 157. Movement of the exercising members from the retracted position to the extended position 52 causes the pistons 65 within the pneumatic cylinders to move upwardly thus reducing the size of the chambers 66 and compressing the air within the chambers 66, third supply conduits 158, first chambers 92 and second supply conduits 157. It will be seen that since the effective resistance against such movement is increased as movement is continued by further pressurization of the air within the system, no inertia effect, as is created in the case of "weight type" devices, is possible in the pneumatic exercising device 10 of the present invention. In fact, the force required to move the arms to the extended positions 52 steadily increases as air pressure is increased within the system. However, downward movement of the arms from the extended positions 52 to the retracted positions 51 requires that the operator work against the stored air pressure in the system to avoid the rapid return of the members. Thus, the device 10 in this respect closely simulates the effect of normal weight lifting operations in concentric-eccentric muscular movements.

When the members 45 are again returned to their retracted positions 51, the plungers 37 are depressed to their retracted positions 39. This opens the valves 36 again to permit compressed air to flow through the valves to replenish the supply of compressed air against which exercising force is exerted if any has been bled off during the compression operation. Similarly, the operator is then free to adjust the dial 75 to create a greater or lesser degree of air pressure within the system against which he works during exercising operation. Additionally the operator can adjust the volume within the first chambers 92 of the pressure tanks 87 if he desires. The pressure gauges 67 record for the operator the pressure created in the device throughout each exercising stroke.

The operator is free to use the exercising members 45 individually or together. The percentage increase in the resistance force created during movement of the members to the extended positions can individually be adjusted to fit the needs of the operator. A variety of types of exercises can be performed on the device and the mechanisms herein described are adaptable to a wide variety of specific structural types of exercising devices designed for a range of types of exercises.

Therefore, the pneumatic exercising device of the present invention simulates the desired characteristics of "weight type" exercising machines permitting the operator to increase both the magnitude of the weight effectively lifted and the speed with which such weight can be lifted; demanding the full effort of the operator throughout the exercising stroke by preventing the adverse effect of inertia of motion; and is compact, dependable and permits a virtually infinite range of adjustment of the extent and character of the resistance force applied.

Although the invention has been herein shown and described in what is conceived to be the most practical and preferred embodiment, it is recognized that departures may be made therefrom within the scope of the invention, which is not to be limited to the illustrative details disclosed.

Having described my invention what I claim as new and desire to secure by Letters Patent is:

1. In an exercising device including a frame, a member mounted on the frame for movement by a user, a source of gas and a pneumatic resisting mechanism connected to said member and connected in gas receiving relation to said source of gas and operable to compress gas received from the source to provide a resistance to movement of said member, an improvement comprising a reservoir having space available to receive gas from said source and mounted in communication with said gas received by the resisting mechanism, and means for selectively varying the size of the space available within the reservoir to define a fixed volume for the receipt of said gas for compression during exercising as said member is moved by the user.

2. An exercising device comprising a frame; a member borne by the frame for movement relative thereto from and to a starting position in response to the application of muscular force during exercising; a source of a gas; and means interconnecting said member and the frame and connected to the source for the receipt of gas therefrom for resisting movement of the member relative to the frame by compressing said gas as the member is moved, said resisting means having a reservoir communicating with said gas received from the source, means for varying the size of the space available within the reservoir for the receipt of a selected volume of gas for compression during said movement of the member and a valve affixed on the device in position for operation by the member in said starting position to permit gas to flow from the source into the reservoir.

3. In an exercising device mounting a member for movement relative to the device upon the application of force against the member, an assembly for resisting movement of the member comprising a housing enclosing a sealed chamber; means borne by the housing for selectively varying the volume of vacant space within the chamber including a liquid system operable selectively to introduce liquid to and alternatively to remove liquid from the chamber correspondingly to reduce and alternatively to enlarge the volume of vacant space within the chamber; a source of gas connected in supplying relation to the chamber; and means interconnecting the device and the member and communicating with said chamber for compressing said gas in the chamber upon predetermined movement of the member relative to the device by the application of muscular force during exercising.

4. The assembly of claim 3 wherein the housing has a substantially airtight second chamber containing said liquid, the second chamber is connected to said first chamber by a conduit, and said source of gas is connected to the second chamber through a control valve operable to admit gas to the second chamber to pressurize said second chamber to force liquid through the conduit into the first chamber to reduce the volume of vacant space in the first chamber.

5. The assembly of claim 4 wherein said control valve is operable selectively to release pressure from the second chamber to create a pressure imbalance between the chambers forcing the liquid from the first chamber along said conduit into the second chamber to enlarge the volume of vacant space in the first chamber.

6. In an exercising device mounting a member for movement relative to the device upon the application of force against the member, an assembly for resisting movement of the member comprising a housing enclosing a sealed chamber; means borne by the housing for selectively varying the volume of vacant space within the chamber; a normally closed valve mounted on the device engageable at a predetermined position to open the normally closed valve and wherein said member is borne by the device for movement from and to a retracted position in engagement with the normally closed valve in said predetermined position; a source of gas; a supply conduit interconnecting the source of gas, the normally closed valve and the chamber in series relation; and means interconnecting the device and the member and communicating with said chamber for compressing said gas in the chamber upon predetermined movement of the member relative to the device by the application of muscular force during exercising.

7. A pneumatic exercising device comprising a frame; a member mounted on the frame for pivotal movement from and to a starting position in response to the application of muscular force during exercising; a normally closed valve secured on the frame in a predetermined position for engagement by the member in said starting position to open the normally closed valve; a pneumatic cylinder interconnecting the frame and the member having an internal chamber progressively reducible in volume during movement of the member from the starting position; a reservoir having an internal chamber; means for selectively reducing and alternatively enlarging the volume of said chamber of the reservoir; a source of compressed gas; and a conduit system interconnecting in gas supplying relation the source, the normally closed valve, the reservoir and the pneumatic cylinder in series relation whereby movement of the member from said starting position compresses the gas in the cylinder, the reservoir and the conduit system downstream from said normally closed valve.

8. The device of claim 7 wherein the source of compressed gas has means for selecting the pressure of the gas supplied to the conduit system.

9. The device of claim 7 wherein the frame has a second member mounted thereon for individual pivotal movement from and to a starting position corresponding to that of the first mentioned member and the second member has a normally closed valve, a pneumatic cylinder and an individually adjustable reservoir individual thereto and connected to said source of compressed gas through an individual conduit system as is said first mentioned member to permit individual exercising movement of said members.

10. The device of claim 7 wherein said reservoir has a second chamber containing a liquid, a gas conduit extends from the source into communication with the second chamber, a liquid conduit interconnects the first and second chambers of the reservoir, and a control valve is mounted in communication with said gas and liquid conduits and is operable to be disposed in a normal attitude in which said gas and liquid conduits are closed at the control valve and an attitude in which said gas and liquid conduits are open through the control valve to cause compressed gas to force said liquid through the liquid conduit into the first chamber to reduce the volume of vacant space therein.

11. The device of claim 10 wherein a pressure release conduit communicates with said second chamber through the control valve and extends to the exterior of the reservoir and said control valve is operable to be disposed in an attitude closing the gas conduit and opening the pressure release conduit and liquid conduit through the control valve to release compressed gas from said second chamber creating a pressure imbalance between said first and second chambers forcing said liquid from the first chamber through the liquid conduit and into the second chamber to enlarge the volume of vacant space in the first chamber.

12. A pneumatic exercising device comprising a frame; a rigid member mounted on the frame for movement along a predetermined path of travel from and to a starting position by the application of muscular force during exercising; a source of gas; a pneumatic cylinder interconnecting the member and frame for extension and contraction along an axis by the exertion of muscular force against the member along a path substantially parallel to said axis of the pneumatic cylinder; a normally closed valve; means borne by the frame and operably connected to the normally closed valve for opening the normally closed valve when the member is in said starting position; and means interconnecting the source of gas, the normally closed valve and the pneumatic cylinder in series relation for supplying gas to the cylinder to resist movement of the member along said path of travel from the starting position by compression of said gas within the pneumatic cylinder and providing communication between the source of gas and the pneumatic cylinder through said normally closed valve when the member is in the starting position and preventing communication between the pneumatic cylinder and the source of gas through said normally closed valve when the member is moved from the starting position.

13. A device for exercising muscles during repetitious concentric-eccentric movements along a predetermined path at a speed limited only by the strength of a user while maintaining such muscles under substantially continuous stress, the device comprising:

A. a frame,

B. exercising means mounted on the frame for reciprocal movement in opposite directions along only one predetermined path, said means having a portion engageable by a user, said portion receiving forces applied by a user to impart reciprocal movement to said means in response to concentric-eccentric muscle movement along said predetermined path;

C. a pneumatic system including a cylinder having an interior with a piston movable therein to define a chamber on one side of the piston in said interior which reduces in size as the piston is moved in one direction on an energy storing compression stroke and which increases in size as the piston is moved in the opposite direction on an energy releasing stroke and said pneumatic system containing a gas sealed within the pneumatic system and at least a portion of said gas being within said chamber sealed from the interior of the cylinder on the side of the piston opposite to the chamber; and D. a linkage interconnecting the piston and the exercising means, said linkage being substantially rigid from the piston to said portion engageable by the user whereby reciprocal movement of the exercising means is communicated to the pneumatic system successively to store energy in the system on the compression stroke and to apply such stored energy to the exercising means along said predetermined path on the energy releasing stroke.

14. A pneumatic exercising device comprising:

A. a frame;

B. a rigid member mounted on the frame for movement from and to a starting position;

C. a source of gas;

D. a pneumatic cylinder interconnecting the member and frame for extension and contraction by said movement of the member from and to the starting position;

E. a normally closed valve;

F. means operably connected to the normally closed valve for opening the normally closed valve when the member is in said starting position; and G. means interconnecting the source of gas, the normally closed valve and the pneumatic cylinder in series relation to supply gas from the source to the cylinder through the normally closed valve when the member is in the starting position and to seal the cylinder from the source by the normally closed valve when the member is moved from the starting position by the application of muscular force during exercising to resist said movement of the member by the compression of gas within the pneumatic cylinder.

* * * * *

UNITED STATES PATENT AND TRADEMARK OFFICE

CERTIFICATE OF CORRECTION

PATENT NO. : 4,257,593

DATED : March 24, 1981

INVENTOR(S) : Dennis L. Keiser

It is certified that error appears in the above-identified patent and that said Letters Patent are hereby corrected as shown below:

Column 3, line 9, after "position.", begin a new paragraph;

Column 6, line 1, between "of" and "fluid", insert ---liquid---.

Signed and Sealed this

*Thirtieth* Day of *June 1981*

[SEAL]

*Attest:*

RENE D. TEGTMEYER

*Attesting Officer*

*Acting Commissioner of Patents and Trademarks*